US008405008B2

(12) United States Patent
Leung

(10) Patent No.: US 8,405,008 B2
(45) Date of Patent: Mar. 26, 2013

(54) POSITIVE TEMPERATURE CO-EFFICIENT HEATING ELEMENT ASSEMBLY AND APPLIANCE INCORPORATING THE HEATING ELEMENT ASSEMBLY

(75) Inventor: Cheuk Fu Leung, Hong Kong (CN)

(73) Assignee: Simatelex Manufactory Co. Ltd., Chaiwan (HK)

( * ) Notice: Subject to any disclaimer, the term of this patent is extended or adjusted under 35 U.S.C. 154(b) by 296 days.

(21) Appl. No.: 12/718,245

(22) Filed: Mar. 5, 2010

(65) Prior Publication Data

US 2011/0215082 A1 Sep. 8, 2011

(51) Int. Cl.
*H05B 3/02* (2006.01)

(52) U.S. Cl. ..... 219/546; 30/541; 219/540; 219/548

(58) Field of Classification Search ..... 219/546; 30/541

See application file for complete search history.

(56) References Cited

U.S. PATENT DOCUMENTS

| | | | | |
|---|---|---|---|---|
| 3,735,625 | A * | 5/1973 | Murao | 72/275 |
| 5,453,599 | A * | 9/1995 | Hall, Jr. | 219/544 |
| 6,121,585 | A * | 9/2000 | Dam | 219/438 |
| 2003/0226258 | A1 * | 12/2003 | Patrick | 30/34.05 |
| 2006/0056891 | A1 * | 3/2006 | Hashiguchi et al. | 399/329 |

* cited by examiner

*Primary Examiner* — Chuong A Luu
*Assistant Examiner* — Robert Bachner
(74) *Attorney, Agent, or Firm* — Leydig, Voit & Mayer, Ltd.

(57) ABSTRACT

A heating element for an electrical appliance, such as an electric razor. The element has a hollow metallic sleeve having first and second sides. The first side of the sleeve has greater thermal mass than the second side of the sleeve. A positive temperature coefficient ceramic element is located within the sleeve and held in thermal contact with the sleeve by a compressed portion of the sleeve.

10 Claims, 3 Drawing Sheets

POSITIVE TEMPERATURE CO-EFFICIENT HEATING ELEMENT ASSEMBLY AND APPLIANCE INCORPORATING THE HEATING ELEMENT ASSEMBLY

FIELD OF THE INVENTION

The present invention relates to heating elements, and in particular to a positive temperature co-efficient (PTC) heating element for use in electrical appliances.

BACKGROUND TO THE INVENTION

Positive temperature co-efficient (PTC) heating elements are widely used in electrical appliances due to their safe self regulating temperature characteristics.

A PTC heating elements comprising a ceramic stone, typically of doped polycrystalline ceramics based on Barium Titanate, which produces heat when subjected to an electrical voltage. The ceramic stone can produce in a variety of different shapes and sizes through a process of blending, milling, drying and sintering. Metallised contacts are applied to the ceramic in order to facilitate the application with electrical voltage. When electrical voltage is applied to the ceramic it heats up very quickly and plateaus at a predetermined reference temperature. Hitherto, PTC elements have been made for electrical appliances by wrapping the metallised ceramic in insulating tape and crimping it within an aluminium sleeve. Heat from the ceramic is transferred to the aluminium sleeve.

SUMMARY OF THE PRESENT INVENTION

It is an object of the present invention to make a heating element for an electrical appliance, and in particular a PTC heating element, which has improved heating characteristics to a "use side" of the element or which at least provides the public with the useful alternative.

The invention provides a heating element for an electrical appliance, such as an electric razor. The element has a hollow metallic sleeve having first and second sides, the sleeve being formed or otherwise arranged so that the first side of the sleeve has greater thermal mass that the second side of the sleeve. A positive temperature coefficient ceramic element is located within the sleeve and held in thermal contact with the sleeve, generally, by compressing a portion of the sleeve about the ceramic element.

Preferably, although not essentially, parts of the second side of the sleeve are removed by milling or machining. Generally, the sleeve comprises an elongate rectangular sleeve having a centre portion and two end portions and wherein the second side of the sleeve is removed at the two end portions. In some embodiment the milling or machining may completely remove a part or the sleeve, or alternatively the milling may think the wall of the sleeve on the second side thus reducing the thermal mass of the second side.

The invention provides an electrical appliance having a part to be heated. There is a recess within the part to be heated and a heating element according to the invention is located within the recess and held within the recess by epoxy resin. Removal of the two end portions of the second side of the sleeve allows the epoxy resin fill a portion of the sleeve. In a preferred aspect of the invention provides an electric razor comprising a razor and a razor stand. The heating element is located in the razor stand.

BRIEF DESCRIPTION OF THE DRAWINGS

The invention will now be described as referenced to the accompanying drawings in which.

DETAILED DESCRIPTION OF THE INVENTION

Figure 1:
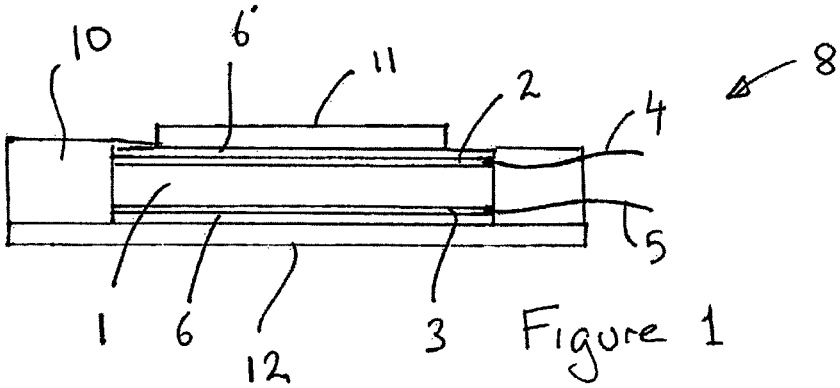
FIG. 1 is a side section view through a PTC heating element according to the invention.

Before any embodiments of the invention are explained in detail, it is to be understood that the invention is not limited in its application to the details or arrangements set forth in the following description or illustrated in the drawings. The invention is capable of other embodiments and of being practiced or of being carried out in various ways. Also, it is to be understood that the phraseology and terminology used is for the purpose of description only and should not be regarded as limiting.

Figure 2:
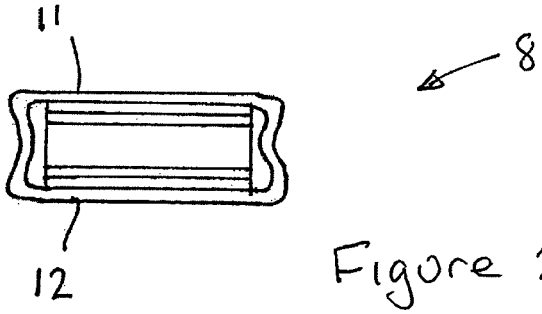
FIG. 2 is an end section view of the PTC heating element.
Figure 3:
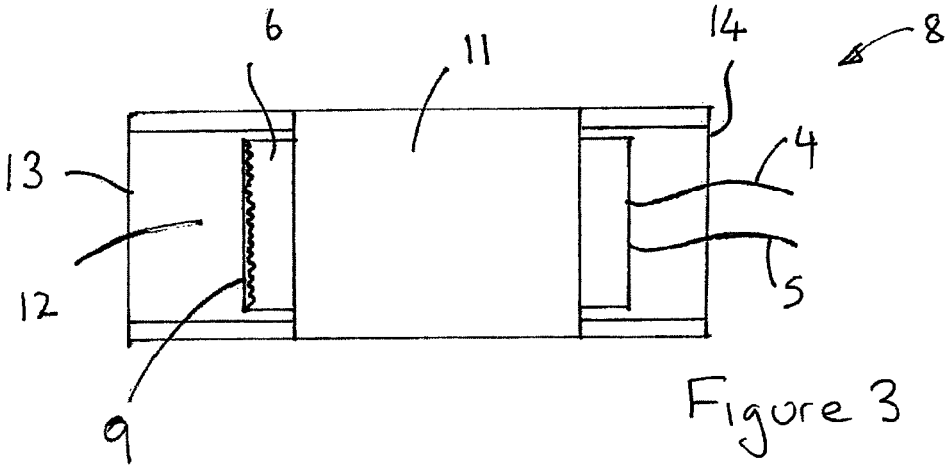
FIG. 3 is a top view of the PTC heating element.

Referring to FIGS. 1 through 3, there is illustrated a heating element 8 for an electrical appliance and such like device according to the invention. The PTC element 8 has a generally rectangular shaped PTC ceramic block 1 made of doped polycrystalline or other known ceramic that produces heat when subjected to an electric voltage. Two bronze electrode plates 2, 3 are bonded to the upper and lower surfaces of the ceramic 1 by heat conductive glue. Electrical wires 4, 5 are connected to respective electrode plates 2, 3 for supplying an electric voltage to the ceramic 1. The ceramic 1 and electrodes 2, 3 are wrapped in a heat conductive insulating film 6. In the preferred embodiment the film is Kapton polyimid film which is a wide range of temperatures. The film 6 is crimped at its distal end 9 and the other end accommodating wires 4, 5 is sealed with an epoxy. The film wrapped PTC ceramic is then located within a hollow rectangular shaped aluminium sleeve 10 and crimped by pressing the upper and lower walls of the sleeve towards each other to secure the ceramic 1 within the sleeve 10.

Figure 4:
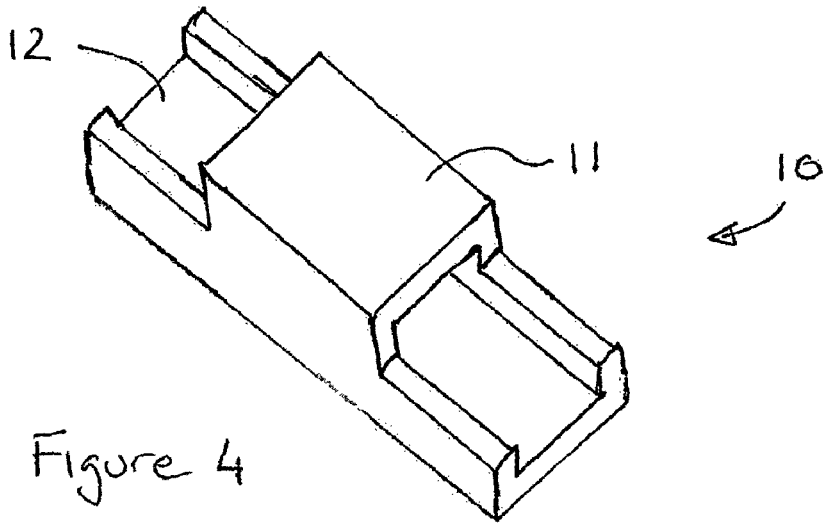
FIG. 4 is a perspective view of a sleeve part of the heating element which accommodates a heating ceramic.

The hollow sleeve is illustrated in detail in FIG. 4. The sleeve has a generally rectangular shape with front and back sides 12, 11 respectively and first and second ends 13 and 14 respectively. The front side 12 of the sleeve 10 is intended to form the heating or "hot" surface of the heating element in use. The aluminium sleeve 10 is milled or likewise machined in order to remove parts of the back side 11 of the sleeve at the two ends 13, 14, thus leaving only a section of the back side 11 at the centre port of the sleeve. Removing parts of the back side 11 of the sleeve 10 reduces the amount of aluminium metal in this side of the sleeve 10 which can absorb heat from the PTC ceramic. Therefore, as the back side 11 of the sleeve has a lower thermal mass than the front side 12 of the sleeve a greater amount of heat is transferred to the front side 12 of the sleeve resulting in a more efficient heating element. Enough of the back side 11 of the sleeve is left to firmly crimp the ceramic 1 within the sleeve thus ensuring good thermal contact between the sleeve 10 and the ceramic 1.

Figure 6:
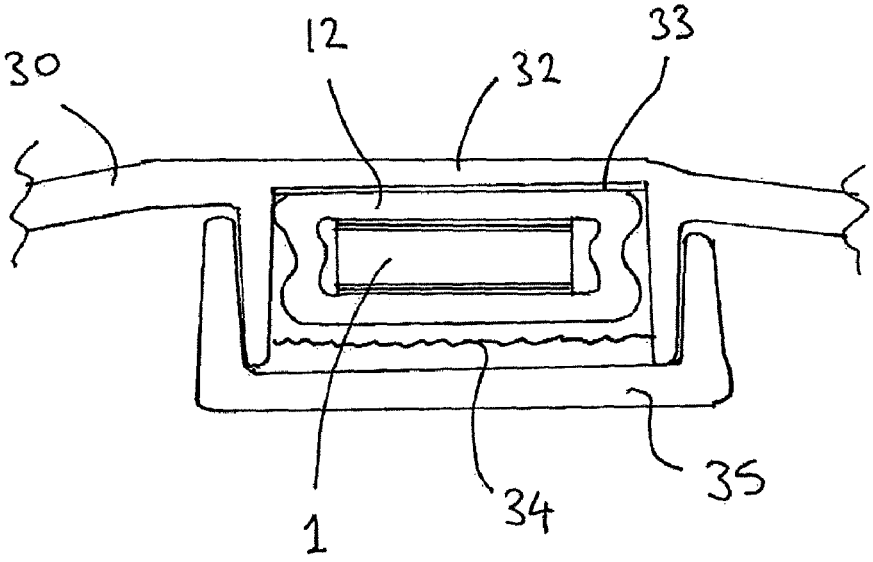
FIG. 6 is a cross-section through the heating part of the appliance of FIG. 5.
Figure 5:
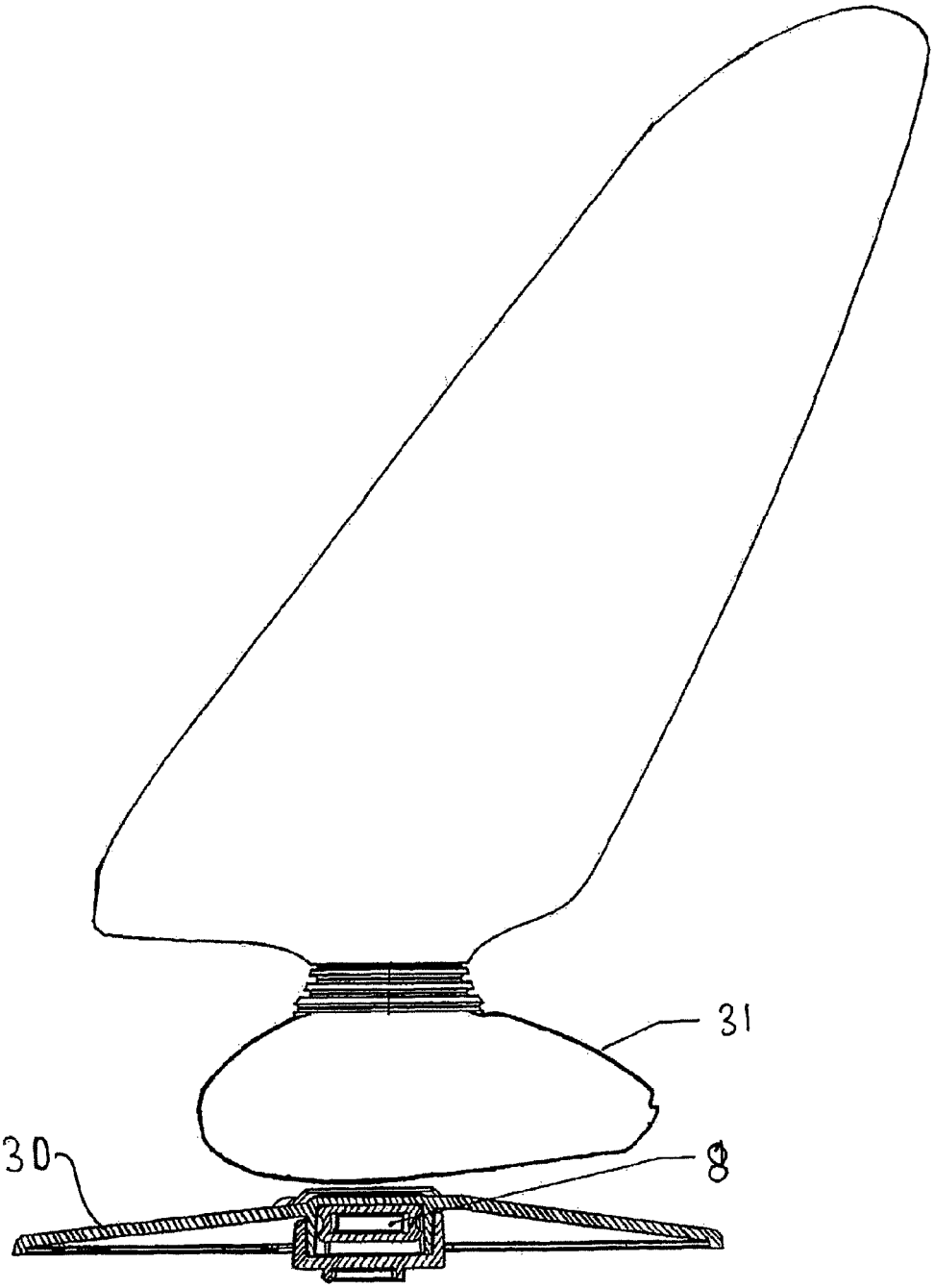
FIG. 5 is a schematic illustration of an electrical appliance utilizing a PTC heating element according to the invention.

Referring to FIGS. 5 and 6, there is shown application of the PTC element 8 in an electrical appliance. In the illustrated embodiment the appliance is the base of a stand 30 for supporting a wet and dry razor 31. The stand 30 is heated by the PTC element 8 in order to provide warming and drying of the razor 31. The stand comprises a hollow recess into which a PTC element 8 is located with the front "hot: side 12 abutting against the area 32 of the stand 30 to be warmed by the element 8. In the preferred embodiment heat conductive paste and/or a heat conductive adhesive tape 33 is located between the hot side of the sleeve 12 and the stand 30 in order to secure the PTC element within the recess of the stand 30 and ensure good thermal contact between the hot side of t sleeve and the area 32 of the stand being warmed. The recess within the base is then filled with epoxy resin 34 in order to encapsulate and bond the PTC element 8 within the stand 30. A lower cover 35 can be provided a foot for the stand 30. An additional advantage of the milled sleeve 30 is that the encapsulating epoxy 34 can flow into the sleeve to keep the ceramic 1 firmly within the sleeve 10 and prolong the useful life of the appliance.

What is claimed is:

1. A heating element assembly for an electrical appliance, the heating element assembly comprising:

a hollow metallic sleeve having a first portion with opposed first and second ends separated by a first length that extends along the hollow metallic sleeve, and a second portion, joined to and opposite the first portion, and having a second length that extends along the hollow metallic sleeve, wherein the second length is shorter than the first length so the first portion of the hollow metallic sleeve has a larger thermal mass than the second portion of the hollow metallic sleeve, and a positive temperature coefficient ceramic element located within the hollow metallic sleeve, between the first and second portions of the hollow metallic sleeve, and in thermal contact with the hollow metallic sleeve.

2. An electrical appliance comprising:

a base for supporting an object placed on the base;

a recess within the base;

a heating element assembly located within the recess and held within the recess by epoxy resin, wherein the heating element assembly includes a hollow metallic sleeve having a first portion with opposed first and second ends separated by a first length that extends along the hollow metallic sleeve, and a second portion, joined to and opposite the first portion, and having a second length that extends along the hollow metallic sleeve, wherein the second length is shorter that the first length so that the first portion of the hollow metallic sleeve has a larger thermal mass than the second portion of the hollow metallic sleeve; and a positive temperature coefficient ceramic element located within the hollow metallic sleeve, between the first and second portion of the hollow metallic sleeve, and in thermal contact with the hollow metallic sleeve.

3. The electrical appliance of claim 2 wherein the epoxy resin fills a portion of the hollow metallic sleeve.

4. The electrical appliance of claim 2, wherein the object to be heated is a razor, and the base comprises a razor stand.

5. The heating element assembly of claim 1, wherein the second portion of the hollow metallic sleeve is centrally located with respect to the first portion of the hollow metallic sleeve and the first length of the first portion of the hollow metallic sleeve so that the first portion of the hollow metallic sleeve has a central portion opposite the second portion of the hollow metallic sleeve, and two end portions which are not opposite any part of the second portion of the first portion of the hollow metallic sleeve.

6. The heating element assembly of claim 5, wherein the first and second portions of the hollow metallic sleeve are closer to each other within a part of the central portion of the hollow metallic sleeve than elsewhere, clamping the positive temperature coefficient ceramic element within the hollow metallic sleeve.

7. The heating element assembly of claim 1, wherein the hollow metallic sleeve has, in a cross-section transverse to the first length, a generally rectangular shape having opposed first and second sides respectively constituting the first and second portions of the hollow metallic sleeve, and third and fourth sides joining the first and second sides to each other.

8. The electrical appliance of claim 2, wherein the second portion of the hollow metallic sleeve is centrally located with respect to the first portion of the hollow metallic sleeve and the first length of the first portion of the hollow metallic sleeve so that the first portion of the hollow metallic sleeve has a central portion opposite the second portion of the hollow metallic sleeve, and two end portions which are not opposite any part of the second portion of the first portion of the hollow metallic sleeve.

9. The electrical appliance of claim 8, wherein the first and second portions of the hollow metallic sleeve are closer to each other within a part of the central portion of the hollow metallic sleeve than elsewhere, clamping the positive temperature coefficient ceramic element within the hollow metallic sleeve.

10. The electrical appliance of claim 2, wherein the hollow metallic sleeve has, in a cross-section transverse to the first length, a generally rectangular shape having opposed first and second sides respectively constituting the first and second portions of the hollow metallic sleeve, and third and fourth sides joining the first and second sides to each other.

* * * * *